US009677849B2

(12) United States Patent
Morrison

(10) Patent No.: US 9,677,849 B2
(45) **Date of Patent: *Jun. 13, 2017**

(54) BOW SIGHT APPARATUS HAVING MULTIPLE LASERS

(71) Applicant: Jay Morrison, The Hills, TX (US)

(72) Inventor: Jay Morrison, The Hills, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/170,868

(22) Filed: Jun. 1, 2016

(65) Prior Publication Data

US 2016/0282086 A1 Sep. 29, 2016

Related U.S. Application Data

(63) Continuation of application No. 14/455,445, filed on Aug. 8, 2014, now Pat. No. 9,377,272.

(60) Provisional application No. 61/864,398, filed on Aug. 9, 2013.

(51) Int. Cl.

| | |
|---|---|
| ***F41G 1/467*** | (2006.01) |
| ***F41B 5/14*** | (2006.01) |
| ***F41G 1/35*** | (2006.01) |

(52) U.S. Cl.

CPC ..... *F41G 1/467* (2013.01); *F41B 5/1492* (2013.01); *F41G 1/35* (2013.01)

(58) Field of Classification Search

CPC ..... F41G 1/467; F41G 1/35; F41B 5/1492
USPC ..... 33/265; 124/87
See application file for complete search history.

(56) References Cited

U.S. PATENT DOCUMENTS

| | | | | |
|---|---|---|---|---|
| 4,894,921 | A * | 1/1990 | Barlow | F41G 1/467 33/265 |
| 5,239,760 | A * | 8/1993 | Dixon | F41G 1/467 124/87 |
| 5,419,050 | A * | 5/1995 | Moore | F41G 1/35 124/87 |
| 5,495,675 | A * | 3/1996 | Huang | F41G 1/467 124/87 |
| 6,073,352 | A * | 6/2000 | Zykan | F41G 1/467 33/265 |
| 6,366,344 | B1 * | 4/2002 | Lach | F41G 1/35 33/265 |
| 7,255,035 | B2 * | 8/2007 | Mowers | F41G 1/467 42/131 |
| 7,313,871 | B2 * | 1/2008 | Lines | F41G 1/34 124/87 |
| 8,065,807 | B2 * | 11/2011 | Rucinski | F41G 1/467 124/87 |
| 8,316,551 | B2 * | 11/2012 | Gorsuch | F41G 1/467 124/87 |
| 8,336,216 | B2 * | 12/2012 | Samuels | F41G 1/467 124/87 |
| 8,893,701 | B1 * | 11/2014 | Entrup | G03B 29/00 124/86 |
| 9,377,272 | B2 * | 6/2016 | Morrison | F41B 5/1492 |

* cited by examiner

*Primary Examiner* — Christopher Fulton
(74) *Attorney, Agent, or Firm* — Scheinberg & Associates, P.C.; Ki O

(57) ABSTRACT

A multiple laser sight system for an archery bow or the like configured so that the multiple laser systems can be calibrated together and having features such that the user can use one laser system during the day and one laser system during the light. The laser sight is further configured to not interfere with the optional use of conventional sighting pins and the use of evening infrared systems, like the prior art use of night vision goggles.

29 Claims, 6 Drawing Sheets

BOW SIGHT APPARATUS HAVING MULTIPLE LASERS

CROSS-REFERENCE TO RELATED APPLICATION

This application is a continuation of U.S. patent application Ser. No. 14/455,445, filed Aug. 8, 2014, and issued as U.S. Pat. No. 9,377,272, which claims priority from U.S. Provisional Application No. 61/864,398, filed Aug. 9, 2013, both of which are incorporated herein by reference.

TECHNICAL FIELD OF THE INVENTION

The present invention relates generally to hunting accessories and, more particularly, to devices for bow sighting devices for establishing aiming positions while using a bow.

BACKGROUND OF THE INVENTION

There are a large number and variety of bow sights available on the market, all designed with the primary purpose of enabling a user to more accurately deliver an arrow to a target. Many of these do not consider the use of the equipment as hunting equipment that can be used in both day and night. And conventional hunting equipment mimics equipment used for personal combat; for example, sighting devices were developed to prevent the emission of light from the source so that the target cannot identify the user in a combat situation. However, in a hunting situation, the game does not generally hunt back, and there is no need to shield the game from light source emissions. Although hunting and archery technologies have progressed over time, modern archery bow and arrow systems typically do not use any equipment that jeopardizes the illumination of the archer, or shooter. The modern day hunter may track a target from daylight to the evening. At dusk, the hunter is left with only limited resources to track the target. The conventional considerations regarding illumination, pointing devices, and displays must be thrown out when developing hunting equipment for use in dusk or night.

An arrow is typically shot using the arms to pull back the bow string, and to aim and sight by holding the bow and arrow next to the archer's eye. Typically, a bow sight comprises a plurality of pins that may be adjusted by the archer for aiming at targets at different distances. Some bow sights have a single adjustable pin that is moved to the match the distance to the target. Normal multi-pin sights simply have several brass aiming pins which stick out horizontally from a vertical frame mounted in front of the hand grip on the bow. Each pin corresponds to a particular target distance. The archer visually estimates the appropriate range and then sights to the target using the appropriate aiming pin corresponding to that range. A recent innovation involves the use of light gathering fiber optic filaments which provide a self powered illuminated dot that the archer sees at the end of each aiming pin. These fiber optic multiple pin sights have greatly improved the utility of such sights in low light or low contrast lighting situations.

FIG. 1 shows a prior art archery equipment having an archer 100 with a conventional compound bow 110 and a bow sight 120. The bow sight 120 contains pin settings adjusted for 20, 40, 60, 80, and 100 yards, respectively. There is an LCD display that is connected to a laser 130, typically a range measuring conventional laser. The sight may contain a pin sight system wherein LED light is transmitted to the sighting pins via fiber optic cables. Such a system is described in U.S. Pat. No. 6,073,352, titled "Laser bow sight apparatus," invented by Dunne et al. In this figure, the pin sight system contains pins and the user will want to calibrate the laser and adjust the pin settings to set as pre-set values using the laser calibration to measure distance before firing the arrow 140. In this prior art, the pin settings and the optical fibers and LEDs are taught to be utilized with multi-pin sights.

Aiming devices are commonly referred to as "sights" and allow archers to, after sighting in the bow, align an end of a pin with an intended arrow striking position on a target. For purposes of this application, "sights" will also include cameras or videos able to aim at a particular target. These sights are not limited to archers; they can apply to variety of shooting equipment, such as rifles, pistols, and crossbows. (5,491,546A) Pin-based sights typically include multiple sight pins that are vertically spaced from each other and positioned such that different pins are used for shots of different yardages. Accurate use of a multiple pin sight requires accurate range or target estimation by the archer. Laser and other light beam sights for firearms are well known, but they have been little used with bows because their mounting arrangements and range adjustment capabilities are ill suited to the needs of the bow user. U.S. Pat. No. 5,419,050 titled "Range adjustable laser sight for bows" is directed to an adjustable laser beam sight that comprises a sight adapted to mount to a wide variety of modern bows and which provides quick and easy adjustment for ranges and trajectory drops of magnitudes characteristic of a bow and arrow. A trajectory from a bow will drop much more than a bullet fired from most firearms. The '050 Patent compensates for large drops in the arrow trajectory is needed in connection with a bow mounted laser sight. Accordingly, there is a continuing need for an improved light beam sight suitable for use with bows.

There are set difficulties for a hunter that hunts from daylight to dusk. For example, from a free-standing distance, the settings that are established for the laser sight and the pin settings may be lost with the loss of daylight. This is compounded by the fact that the game does not stay still long enough for the archer to draw and release an arrow after finding the range to the animal, whereby the shot opportunity is lost due to the time required for shot preparation.

The use of night vision goggles to spot targets at dusk is well known in the industry. The night vision goggles conventionally work with IR illumination devices. The problem with the use of night vision goggles with hunting bow equipment is the need for the archer to remain steady during a shot.

As shown in FIG. 2, the prior art archer 200 uses a conventional bow 210 with a pin setting system 240. In this figure, the pin settings are calibrated at 20, 40, 60, 80, and 100 yards respectively with pin settings 241, 242, 243, 244, and 245. These pin settings are calibrated during the daylight when the archer 200 has plenty of light to make necessary modifications to distances with known targets. While hunting at night, archery bow hunters are required to perform numerous acts simultaneously to ensure accuracy of a shot. An archer must hold the bow one-handed at a full arm extension while drawing the bowstring with the opposing arm to the full extension of the bowstring. The archer must then attempt to hold the bowstring at full extension while aligning the sighting device eyepiece 247 with the target animal. At night, the archer may use night vision goggles 260 to see the target while taking aim. Unfortunately, the night vision goggles 260 interferes with the archer 200 and the necessary steadiness that is needed to take a shot at an animal. Generally, components 261 of the night vision goggles can even interfere with the rest of an archer's natural position on the bow string 220. This is further complicated by the given the amount of accessories available for archery bows, which may weigh upwards of ten to fifteen pounds and may be unequally weighted. Thus, any equipment attached to the head or arm of the archer during the execution of the bow fire will potentially interfere with the aim. Night vision goggles are often even bulky and heavy, which will further interfere with an archer to remain steady. Thus, there is a need for use of sophisticated night vision capabilities without the conventional night vision equipment. As shown in FIG. 2, the use of prior art night vision goggles 260 is rather awkward when used with the sophisticated bow sight system 210. As shown, archer 200 is pulling back on bow string 220 aiming his arrow 230 in his bow 210. In this system, the archer's face is so close to the bow string 220 that it is either touching the string or very close to touching the string. The archer uses a peep sight that is located in the bow string 220. Thus the archer must look through the peep sight and see the sight pins to aim the bow. Night vision googles will preclude the archer from viewing through the peep sight making it impossible to sight the bow using the current sight pins. The night vision goggles 260 is awkwardly located that prevents the archer from comfortably getting close to the bow 210 and using the sight pin system 240.

What is needed is a sight system used for a bow, or a rifle, pistol, or crossbow, wherein the user can calibrate settings during one time period or environment to be used in a completely different setting and time period, or different environment. More specifically, what is needed is s system that allows a user to calibrate a visible laser system during the day to match certain targets with certain distances, and to allow the use of those settings for a different night time laser. More specifically, the user may calibrate another sight, such as a video, so that they all are calibrated together. To enable this, separate sights must be coordinated so that adjustments made in one sight are transferable to another. What is further needed is a system that displays to the user to calibrate different pin settings with one sight system that allows those pin settings to be used with a different sight. What is needed is a sight that will allow the hunter to quickly gauge the magnification and zoom of the lens to show an impact point of the projectile. What is needed is a laser targeting system that can switch from visible to evening dusk light without the hunter needing to recalibrate. What is needed is an integrated camera system for instant and future playbacks. These components must all include the capability to include these features in a standard sight adapted for a bow. In light of the foregoing, a bow sight is desired that improves the state of the art by overcoming the aforesaid problems of the prior art.

SUMMARY OF THE INVENTION

In accordance with one aspect of the invention, a bow sight system is provided that allows an archer to calibrate his bow based on a number of different environmental conditions. The sight system includes a conventional, visible laser sight for use of the target laser spot during visible hunting hours during the day. The sight system further includes a wheel mount for quick connection and disconnection. The sight also includes an infrared illuminated and IR laser that is coordinated, or calibrated, with the visible laser. The IR laser system includes an LCD screen that shows the intended crosshairs of the target. The IR laser system and the visible laser system and the LCD screen are all coordinated such that calibrating one matches the calibration on the other sighting system.

A hunter can use both the red, green or visible laser and the infrared laser to compensate for situation-specific shooting and environmental factors that influence arrow flight and targeting. And the hunter can calibrate the visible laser during the day and wait until night to switch on a completely different sighting system that is calibrated the same. In the preferred embodiments of the invention, both lasers are connected to each other and move as one unit. This coordination is done with the camera and LCD. With the coordinated system for pin settings, the hunter will have the ability to set five preset ranges for laser assembly and will allow the hunter to adjust for short, medium, and long range targets. The sighting system works so that the pin settings can be used with the visible sight system, and also such that the pin settings for the visible sight is calibrated to the evening sight system.

In accordance with another aspect of the invention, a bow sight is provided that includes both a visible laser and IR laser assembly, a camera, recorder, a processor, at least one source of light (visible or night vision oriented) and automatically corrects and compensates for various dynamically changing aiming, shooting, and/or environmental conditions. The bow sight can include various integrated sensors or other sensing-type devices, such as a range finder, an inclinometer, and an anemometer, which communicate with a processor or other control device. The processor, based on, e.g., signals from the sensors, may illuminate one or more aim indicators provided within a sight array which includes multiple aim indicators. In this configuration, a default sighted-in position can be preliminarily established and designated by a first aim indicator provided within the sight array. Then, during use, the system can correct and compensate for factors such as distance, shot angle and windage settings. In so doing, effects of environmental and use influences can be mitigated by changing a discrete position of the aim indicator within the sight array based on, e.g., shooting angle, wind direction, wind velocity, shot distance or other factors.

In accordance with yet another aspect of the invention, a method of providing and using a bow sight. The method includes using a bow sight wherein multiple sight systems are coordinated so that the calibration of one calibrates all others. The system that is used with the novel method can include (i) a base member attachable to a bow, (ii) a sight array that has multiple electronically selectively tightly spaced displayable aim indicators, (iii) an inclinometer, (iv) a range finder, and (v) a processor that cooperates with the inclinometer, range finder, and (vi) a sight system wherein there are at least one visible laser sight that is automatically calibrated with another laser sight, such as an infrared laser sight. The sight system can also include a third video sight. The inclinometer transmits a signal relating to a shooting angle to the processor. The range finder transmits a signal relating to a shooting distance to the processor. Based on such signal(s), the processor determines which aim indicator within the sight array should be illuminated, and correspondingly illuminates such aim indicator.

DETAILED DESCRIPTION OF PREFERRED EMBODIMENTS

The components of an embodiment of the system of the present invention are shown attached to a variety of projectile firing weapons, namely a bow, a rifle, and a pistol. The preferred bow sight system has selectively infrared illuminating capabilities with displayable laser marks on a LCD screen with a corresponding visible laser spot.

Figure 1:
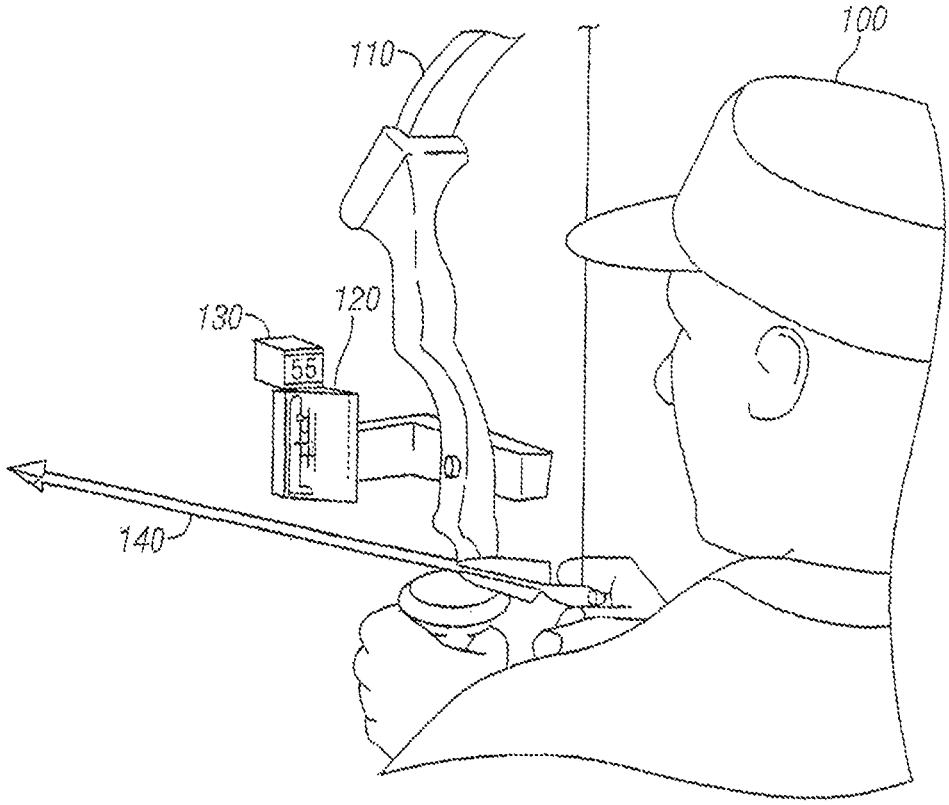
FIG. 1 (Prior Art)
FIG. 1 is a perspective view of a traditional archer and an archery set in accordance with a prior art system.
Figure 2:
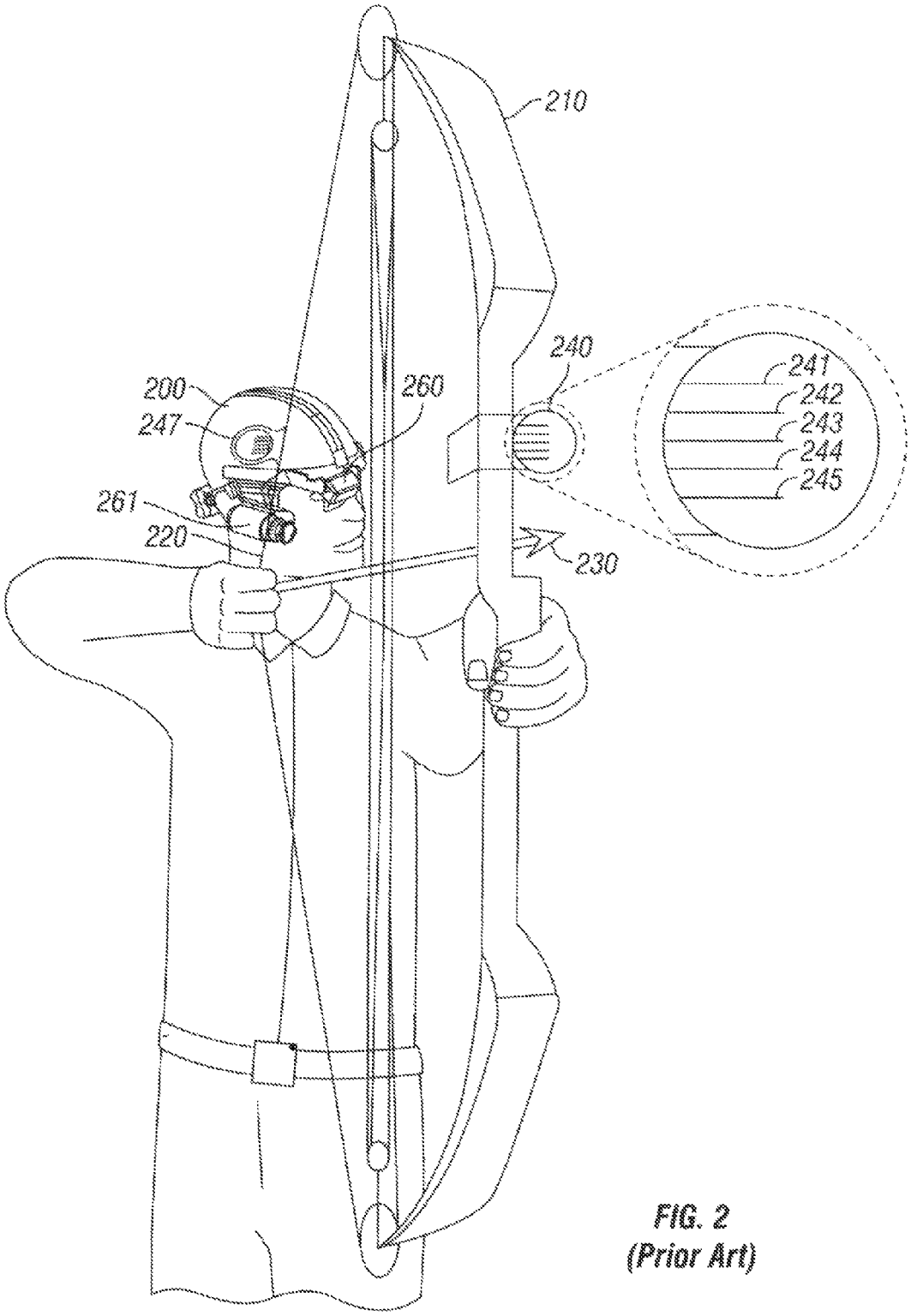
FIG. 2 (Prior Art)
FIG. 2 is a perspective view of a hunter trying to use night vision goggles in accordance with a prior art system.
Figure 3:
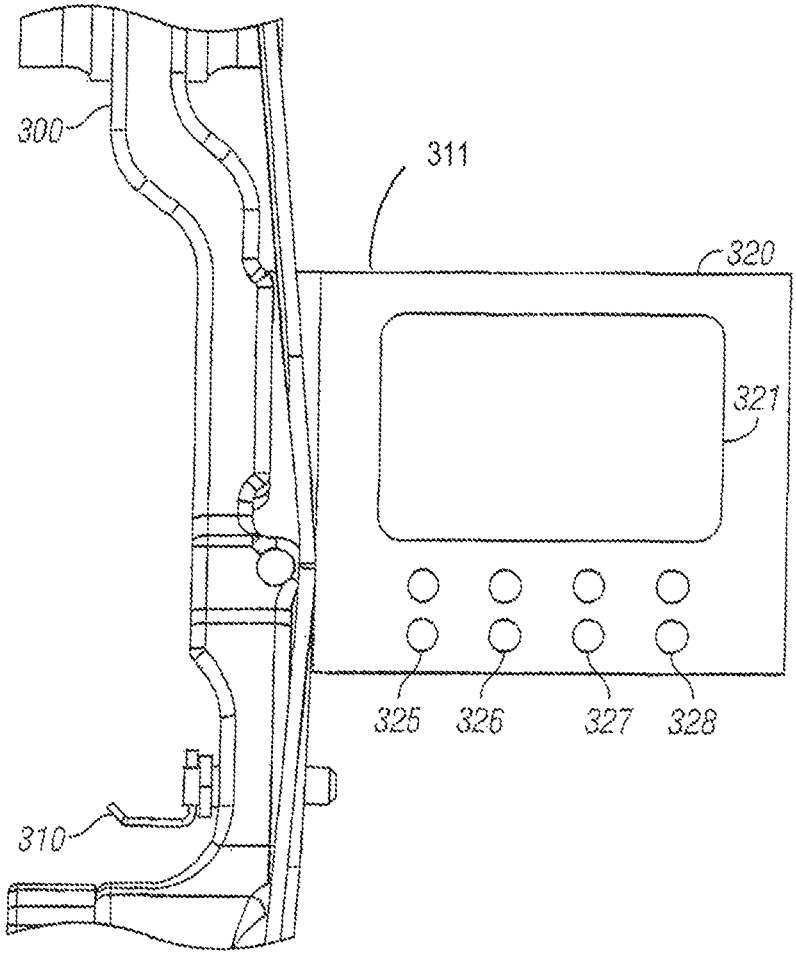
FIG. 3 schematically illustrates the front view of the current invention.

As shown in FIG. 3, a bow system 300 is disclosed in accordance with an embodiment of the current invention. The bow system 300 has a mounting system 310 is adaptable for various crossbow, bow, archery, rifle, or firing arm system. The mounting system can be a conventional mounting system 310, well known in the industry. The mounting system 310 is used to connect the main body 311 of the sight system 320. The sight system 320 is composed of a first visible light laser sight, a second infrared laser sight, and a third video sight that are calibrated with each as discussed below. The main body 311 may be mounted to a weapon using a variety of mounting mechanisms, including those disclosed in more detail in U.S. Pat. No. 5,430,967, titled, "Aiming Assistance Device for a Weapon," issued on Jul. 11, 1995; U.S. Pat. No. 6,574,901, titled, "Auxiliary Device for a Weapon and Attachment Thereof," issued Jun. 10, 2003; and U.S. Pat. No. 6,705,038, titled, "Mounting Assembly for a Weapon," issued on Mar. 16, 2004, all of which are incorporated herein by reference in their entirety. Additionally, the sight system may utilize a mounting mechanism compatible with a mounting rail disclosed in military specifications (e.g., MIL-STD-1913), a "rail grabber" mounting mechanism, levers, screws, bolts, and/or the like.

The main body 311 of the sight system 320 contains an LCD display 321 that provides the digital image created by the third video sight, such as a camera, and aligns properly with calibrated target settings that is established by the archer. Embodiments of the present invention involve the use of the first visible light sight and its automatic calibration with the second infrared laser sight. Embodiments of the present invention also use a third video sight that can be calibrated with the first and second sights. For example, a user can calibrate the first visible light sight, which will calibrate the second infrared sight, which can both be calibrated with the video sight so that the video can precisely shoot at an angle, zoom, and shutter speed, and all other settings that would allow the calibration of the first sight to save or calibrate the video settings.

The preferred embodiment employs a conventional diode laser as a source of visible laser pointer as a first sight. The system includes zoom in and zoom out buttons 325, on/off switches for both the daylight laser and infrared laser 326, laser adjustment buttons 327, and brightness settings 328. The infrared laser pointer assembly and infrared illuminator assembly are used in conjunction.

The visible laser has different settings for different ranges (e.g., U.S. Pat. No. 5,419,050 A). An adjustable laser beam sight system comprises a supporting plate and first, second and third serially arranged and rotationally coupled levers mounted on the supporting plate by two pivots. The first pivot rotationally couples the first lever to the supporting plate and the second pivot rotationally couples the third lever to the supporting plate. A first laser sight comprising a laser beam emitting device is attached to the first lever. Rotation of the third lever, acting through the second lever, imparts a change in direction of the first lever and the laser beam. A range scale with its reference center substantially at the second pivot is provided on the supporting plate. An indicator on the third lever moves across the range scale as the third lever is moved to adjust the aim of the laser beam, thereby indicating a range setting. Laser archery bow sight (e,g, U.S. Pat. No. 6,862,813 B1) is another example of such a laser setup. In accordance with embodiments of the current invention, a second sight is designed so that when the first laser sight is calibrated, the second sight is automatically calibrated. The second sight can comprise a second infrared laser beam system wherein when a user calibrates his hunting settings during the day using the first laser sight, the second sight is automatically calibrated for night-time use.

Figure 4:
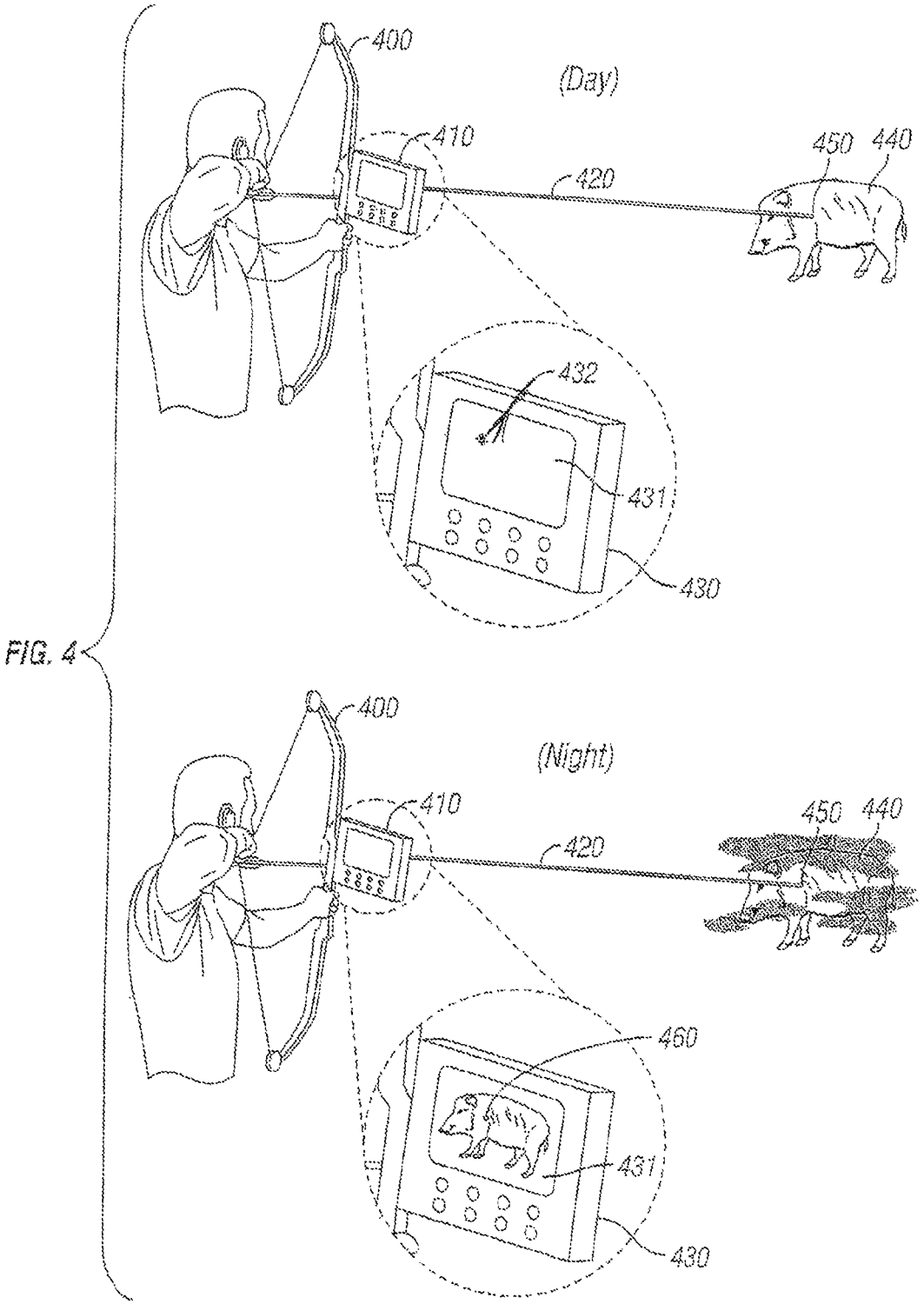
FIG. 4 shows schematically a hunter using the current invention sight device during the day and at night.

The use of an LCD screen and a camera can be pivotal with hunting equipment. As shown in FIG. 4, the archer uses a bow 400 with a bow sight 410 in accordance with one embodiment of the current invention. The sight system is used to direct a laser beam path 420 to the target 440 using target sight 450. The archer is able to calibrate his first laser sight system with conventional known distances prior to the engagement with the animal target 440. For example, the archer is capable of using conventional pin setting system that will mark off certain distances. In accordance with embodiments of the current invention, the pin setting system will coordinate with the first or second sights so that both can be calibrated to the marked off distances. It should be further noted that in accordance with embodiments of the current invention, a third camera sight system 430 and the LCD screen 431 is used so that the target can be additionally viewed on the LCD screen 431. The third sight system can also be set and calibrate with the first and second sights. A mark 460 marks the corresponding spot of target spot 450 that is shown on LCD screen 432.

During the employment of the system at night, there is an optional sensor that detects the settings for evening settings. Conventional light sensors can be used to set the system such that the LCD screen coordinates with the camera during the day and switches to the infrared setting at night. The conventional first visible laser sight is always calibrated so that any adjustments made to the first visible laser sight is coordinated with the second night, or infrared, laser sight. The night laser sight works with internal infrared illuminator to illuminate the target with infrared light. The camera system can also switch the LCD screen from day time to night time infrared screen and allows for the target marking to be on the exact target spot 460 as with the conventional laser. Although the target is not visible in the night, the target 460 on the LCD screen is clearly visible with the use of the infrared light.

Both the daylight laser sight and evening laser sight are coordinated and connected so that they move together. In a preferred form of the invention, the laser is adapted for use with an archery bow. In a preferred form of the invention, the camera and video are also coordinated so that when the user calibrates the first or second sights, the camera can also make pre-set adjustments to follow or view the target better. There are many ways in which a laser can be adjusted to its target. If the second sight is directly attached, it must be attached in a manner that adjustments made on the first sight is also made on the second sight. In an automated system, the calibrations required by the user are stored and extrapolated into the second sight system. In other words, a laser may point at a target and a processor may store information regarding its distance and location such that the night time infrared sight can use it to pinpoint the exact same target.

Figure 6:
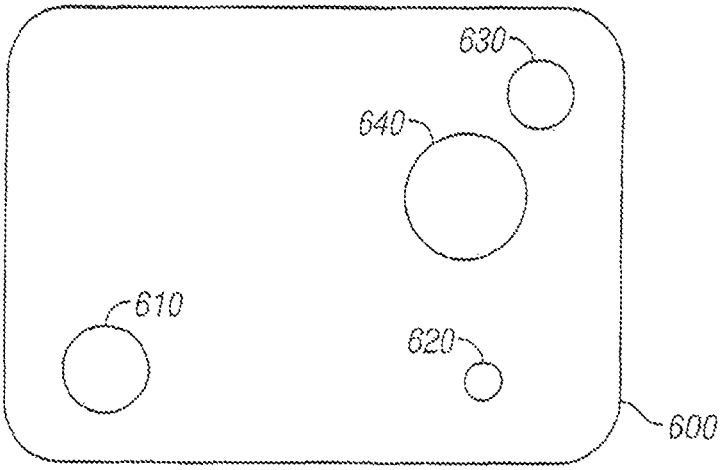
FIG. 6 is a pictorial top view of the bow sight system of FIG. 3.

The laser set may be adjusted using up-down adjuster 610 and 620 in accordance with another embodiment 600 of the current invention as shown in FIG. 6. The left-right adjuster and a top-bottom adjuster coordinate with the infrared illuminator assembly so that it functions to capture the target at night. The divergence of the resulting infrared illuminator beam may be adjusted from a narrow beam to a wide beam by rotation of a beam adjuster. The beam adjustor may have an outside dimension sized to allow an operator to adjust the beam size. Locating the two laser sight assemblies within one beam adjustor can save space. Embodiment 600 includes a power switch 630 for the laser and a power switch 640 for the infrared illuminator. A removable cover camp 551 is used for eyepiece 550.

Figure 5:
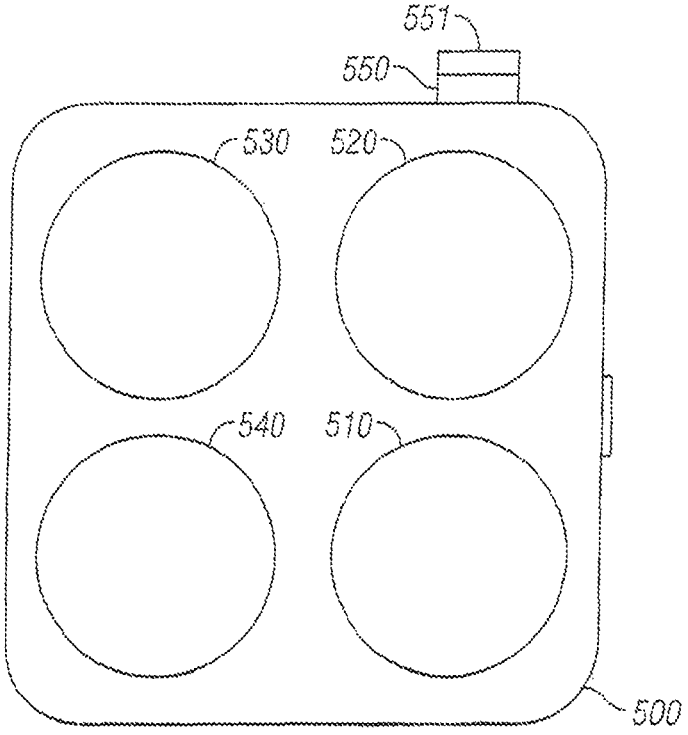
FIG. 5 is a pictorial front view of the bow sight of FIG. 3.

Conventional day laser 530, the first sight, and night laser 540, the second sight, are coupled together as shown in FIG. 5. Because the conventional laser has the ability to adjust vertically and laterally in accordance with the user's use of dials and pin settings, the coupled night vision laser must match exactly with the settings so that when a user calibrates his first sight during the day, the second sight is automatically set to the same settings, such as distances, at night. This is done in one embodiment of the invention by physically coupling the conventional day laser to the infrared night laser and calibrating them so that each movement with one system is aligned perfectly with the other. In one preferred embodiment, a rotator dial is used that has notched pin settings that match the user's use of convention distance systems, like the pin settings, with precise measurements of the laser. The rotator dial can be set to physically alter the first sight and the second sight at the same time so that changing one laser setting changes the other. And unlike the conventional use of night vision goggles that would normally interfere with the shooter, the system in accordance with FIG. 3 stays to the side of the system and does not interfere with the archer or his resting face on or near the bow of the system 300. To save money, the coordination of the first and second sights can be done in a variety of physical ways. They can physically be attached to a different dial setting as described. They can also be attached in a manner that they point precisely only a few inches away from each other so that both sights follow a parallel pathway to its target.

Many settings can be calibrated and transferred to the second sight. Multiple distances and multiple locations can be spotted and used interchangeably between the daytime and nighttime lasers. If a user stores or tracks information regarding the distances of the laser at many points during the day, the user will be able to access those same distances with his LCD screen at night. Such a sight system may have a preferred zoom or brightness for the user. Such information may also be stored so that when a user points his second sight at a target, the camera and LCD screens will immediately allow the user to see the target and its preferred settings. The use of an LCD has advantages to a night time user for bow archers. Because the flew of the string back towards the user, the head of an archer is removed from the actual target sight system. In a rifle, the scope would be right next to the user's eye, but that is not the case with an archer. Thus, and LCD that is capable of zooming in has special advantages for a user that may view the screen from a foot to two feet away.

With modern equipment, the multiple sights with the capabilities to illuminate the target at night and the LCD can all be added to a bow with relative ease. More importantly, the equipment these days are light and require only minimal adjustments by the user. With time, the equipment will advance to produce faster and lighter materials, but the current invention ties together the ability for a user to use his sight system in multiple settings by allowing the user to calibrate one setting for one sight and transfer those settings and its usage to another environment.

In another embodiment of the preferred invention, the calibration of the first and second sights to the same target can be done using some form of programmable instructions. This can be done by having the settings of the first sight and the second sight be coordinated with a controller. The controller can account for different distance settings and can account for the calibration needed so that when a user makes changes to the first sight, the second sight will calibrate on the same target.

While it is contemplated that the preferred embodiment will employ a diode laser as a source of visible red light, it should be appreciated that other types of directed light beams might also be used without departing from the principles of the invention. For example, it is also contemplated that an infrared laser could be used together with goggles worn by the archer that produce visible light in response to stimulation by infrared light. Similarly, a green or other color visible laser may be used. And, in some cases, such as nighttime training exercises, an intense incoherent light source might also be used. Accordingly, for the purpose of the specification, claims, drawings and abstract, "directed beam" shall mean a beam of energy that is substantially collimated from a source thereof to a target that is within a useful range of an archery bow, and includes without limitation a substantially collimated Gaussian light beam produced by a laser.

FIG. 5 is an exploded assembly view of the double-laser assembly consistent with one embodiment of the invention. The system 500 may be incorporated in a weapon mountable sight wherein the conventional red laser 530 is coupled to infrared laser system 540. An illuminator infrared drive ring 520 and a camera lens 510 also make up the front view. The location of visible laser pointer assembly and the infrared laser pointer assembly may be swapped without departing from the invention.

The visible laser pointer assembly may be a type having a conventional diode and spaced a fixed distance from a lens and the infrared laser pointer assembly. The visible laser pointer assembly and the infrared laser pointer assembly may be coupled together in conventional methods including fusing. The conventional lasers must be calibrated precisely so that they can coordinate on different targets when the user changes the setting. In other words, when the user calibrates one laser, the other laser is calibrated exactly the same so that the two lasers can be used together and in conjunction, as well as, one at a time during the different parts of the day.

Figure 7:
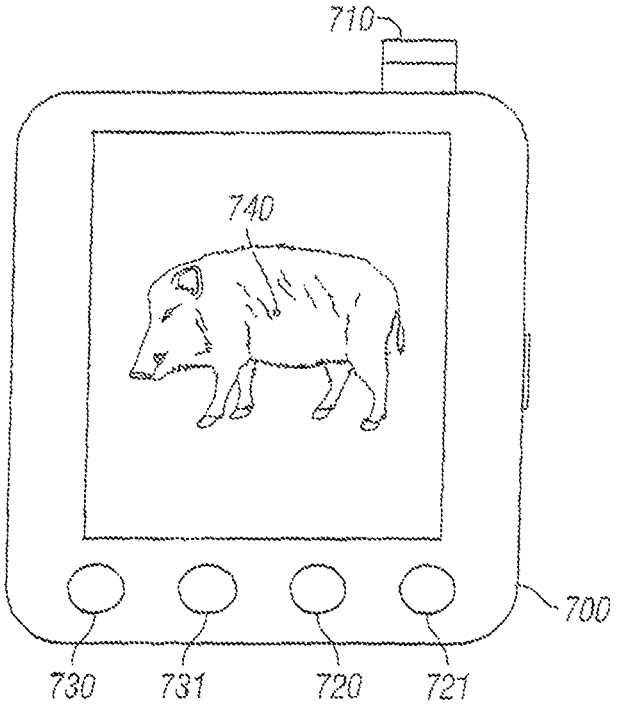
FIG. 7 shows the LCD screen that is employed with the current invention.

The night sight system includes the ability to see the target in the evening, and it works such that the dot of laser light that is projected on a distant targeted object can be viewed through the LCD screen wherein the aim indicators that are illuminated or otherwise visually or audibly displayed at positions which compensate for such situation-specific shooting and environmental factors in a manner that allows an archer to take "dead aim" with, or aim directly at, an intended target at all times. FIG. 7 shows an LCD screen in accordance with another embodiment of the current invention including a sighting mechanism 710. LCD system 700 can be used with the evening laser system or can be used with the daytime camera, used in a conventional camera LCD screen methods well known in the industry. Spot 740 is calibrated accordingly by both the daylight and evening laser systems. Zoom features 730 and 731 and brightness setting 720 and on/off button 721 are conventional buttons on LCD camera screen systems.

Figure 8:
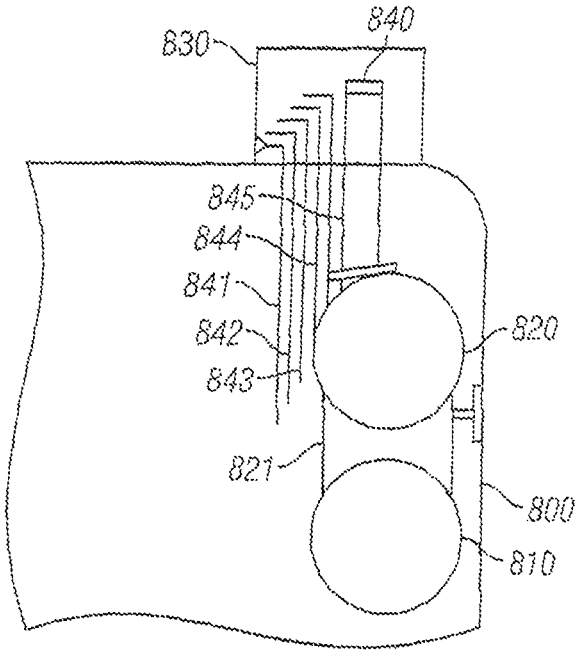
FIG. 8 shows a pin setting interior of the current invention in accordance with one embodiment.

FIG. 8 shows a system having a sighting mechanism 830 where the first sight and the second sight are attached to each other and coordinated so that the calibrations made by the first sight transfer to the calibrations of the second sight. The customer using the dial in 840 can move the laser vertically either up or down to move lasers 820 and 810 to each of the distance settings in pins 841, 842, 843, 844 and 845. Each pin 841-845 can be adjusted vertically either up or down to set the distance for the lasers 820 and 810. The daytime laser 820 is connected with the evening laser system 810 with a connector 821 such that any coordinated movement to adjust the calibration on the target is done together and coordinated so that any setting set by the daytime laser system can be used by the evening laser system. Optionally, a third sight, that includes a camera and LCD screen, can be coordinated with the first daytime laser sight and the second evening laser sight.

The following is a possible manner to use the current invention. An archer uses the current bow sight by mounting it on his/her bow. During the day, the archer finds a location to hunt and calibrates his conventional pin settings (240) so that the archer knows which pin setting to use for various distances. The archer calibrates his first sight (841), which includes a conventional red laser, so that the different distances match with the settings. The archer can optionally have a rangefinder in the system that can measure exact distances. The archer is now prepared to point, direct the laser, and have an immediate assessment of how to fire depending on the pin setting of the bow. The calibration of the first sight automatically calibrates the second sight system. The automatic calibration is done using a manual connection between the first and the second sight, however, the calibration of the second can be done using a program if both sights are in sync with a processor, or controller, than can account for the different settings and the different distances. This can be done using conventional processors or controller, and optionally, it can be done using a mobile smart device, such as a mobile phone that can attach to the system. In this embodiment, the mobile smart device can also act as the LCD screen and camera that is part of the third sight system. The archer will then perform the same distance setting process with pins 842-845 to set the other distances for the pins with the traditional sighting system (240).

In another embodiment, the multiple sights can only be manually adjusted and individually adjusted when there is switch that goes from "calibration" to "non-calibration." Only in the "non-calibration" mode can each of the sights be calibrated to different targets or to different distances. In this embodiment, each of the sights will require its own adjustment capabilities. But in this embodiment, there must be a "calibration" mode where a user can either switch a button or turn on the feature of a program that makes the first sight and second sights calibrate together. For purposes of this invention, the discussion focusses on only when the first and second sights are linked so that the calibration of the first sight calibrates the second sight.

Once the archer coordinates and calibrates the distances of the first sight, the second sight should also be calibrated. The archer can wait for quite some time before any game shows up. The switch from day to night can bring out different hunt, and in the current system, the second sight system can be used in the different environmental conditions. The different environmental conditions may be a change in weather, temperature, but mostly, it is contemplated that the different change in environmental conditions is a change in time, from day to night. The second sight uses a different laser, an infrared laser, and with its use of an infrared showing LCD screen. The LCD can act as a third sight that stores information and is calibrated so that settings, such as particular zooms, are memorized and calibrated when the user decides to target.

There are pin settings, and the calibration of the pin settings can include at least five preset ranges for various distances to the target using an eye piece that matches five pin settings to various distances. Other settings that may include for the third sight, brightness, zoom, shutter speed, zoom of the LCD screen. It may include all the conventional settings of a normal camera, which can be coordinated with the calibrations of the first or second sight.

Various embodiments of a bow sight will now be described that achieve these and many other goals, it being understood that other configurations may be provided that fall within the scope of the present invention. Such exemplary embodiments of the bow hunting accessory device of the present invention are illustrated in the accompanying drawings in which like reference numerals represent like parts throughout.

I claim as follows:

1. An archery bow sight assembly mountable to an archery bow, comprising:

an adjustable mount capable of attaching to an archery bow;

a housing containing;

a first laser adjustable by a sighting system for setting a spot onto a target at a user-set range, a second laser that is used for setting a spot onto a target in a different environmental condition than that existing with the use of the first laser, and a display with infrared capability for viewing the spot created by either the first or second laser;

wherein the calibration of the first laser to specific distances using the sighting system calibrates the second laser with the first laser.

2. The assembly of claim 1 wherein the calibration is for distances to specific targets.

3. The assembly of claim 2 wherein the calibration also includes adjustments made for elevation to various distances.

4. The assembly of claim 3 wherein the calibration includes multiple preset ranges for various distances to the target.

5. The assembly of claim 1 wherein the first laser is a visible diode laser.

6. The assembly of claim 5 wherein the second laser includes an infrared laser.

7. The assembly of claim 1 wherein the display includes an LCD display that allows the user to see the laser spot created from the first laser.

8. The assembly of claim 7 wherein the display includes an LCD display that allows the user to see the laser spot created from the second laser.

9. The assembly of claim 8 wherein said LCD includes a feature to control the brightness, zoom, and contrast of the LCD screen.

10. The assembly of claim 1 wherein the calibration of the first and second lasers is done manually wherein different settings associated with different distances can be adjusted via the sighting system so that both the first and second lasers can calibrate to the same preset settings at user-specified distances.

11. The assembly of claim 1 wherein the calibration of the first and second lasers is done automatically using a controller that can coordinate the distances and the settings.

12. The assembly of claim 1 wherein the first and second lasers are physically coupled so that calibration of the second laser can also calibrate the first laser.

13. The assembly of claim 1 wherein the housing is detachable.

14. The assembly of claim 1 wherein the display includes a mobile device or smart device that can act as the LCD screen and also provide controller functions to coordinate the calibration.

15. The assembly of claim 1 wherein the display has settings, such as zoom preferences and preferred distances, that use the calibration of the first laser so that when the first laser is calibrated, the display is adjusted using the preferred range settings.

16. The assembly of claim 1 wherein the display has recording capabilities.

17. The assembly of claim 16 including a camera to capture an image of a shot of the target, the camera being connected with the LCD such that the user can view instantly the images captured by the camera.

18. The assembly of claim 1, further including an infrared light source.

19. A method of using an archery bow including:

first calibrating a first laser to various distances during the day time so that the user can match various locations with various settings on the archery bow that instantly show the user where to aim; and using a second laser at different environment conditions than that existing with use of the first laser so that the second laser has the same calibrated settings as the first laser.

20. The method of claim 19 wherein the first laser is a visible diode laser and the second laser is an infrared laser wherein the different environment conditions includes using the first laser during the day and using the infrared laser during the night.

21. The method of claim 19 including using a camera and LCD screen wherein the camera and LCD screen coordinates with the first and second lasers.

22. The method of claim 19, further including an infrared light source.

23. A sight assembly for a hunting device, comprising:

a sight for aiming the hunting device, a calibration mechanism, a visible laser for illuminating a first spot on a first target at a specific distance from the hunting device, the visible laser associated with the calibration mechanism to calibrate the visible laser so that the first spot indicates where a projectile fired from the hunting device will impact the first target when the hunting device is aimed using the sight;

an infrared laser for illuminating a second spot on a second target at the specific distance from the hunting device, the visible laser and the infrared laser being operatively connected such that when the visible laser is calibrated, the infrared laser is also calibrated so that the second spot indicates where a projectile will impact the target; and a display for displaying the second spot and the infrared image of the target to allow a user to calibrate the visible laser during the day and then use the display to aim the hunting device at night.

24. The sight assembly of claim 23 in which the hunting device is a bow.

25. The sight assembly of claim 23 in which the hunting device is a cross-bow.

26. The sight assembly of claim 23 in which the hunting device is a pistol.

27. The sight assembly of claim 23 in which the hunting device is a shotgun.

28. The sight assembly of claim 23 in which the hunting device is a rifle.

29. The sight assembly of claim 23 in which the hunting device is an airbow.

* * * * *